US008469043B2

(12) United States Patent
Tolf

(10) Patent No.: US 8,469,043 B2
(45) Date of Patent: Jun. 25, 2013

(54) DRYING SYSTEM FOR A DISHWASHER

(75) Inventor: Anders Tolf, Jönköping (SE)

(73) Assignee: Electrolux Home Products Corporation N.V., Zaventem (BE)

( * ) Notice: Subject to any disclaimer, the term of this patent is extended or adjusted under 35 U.S.C. 154(b) by 868 days.

(21) Appl. No.: 12/527,329

(22) PCT Filed: Feb. 20, 2008

(86) PCT No.: PCT/EP2008/001295
§ 371 (c)(1),
(2), (4) Date: Dec. 8, 2009

(87) PCT Pub. No.: WO2008/101673
PCT Pub. Date: Aug. 28, 2008

(65) Prior Publication Data

US 2010/0083991 A1 Apr. 8, 2010

(30) Foreign Application Priority Data

Feb. 20, 2007 (EP) ..... 07075143

(51) Int. Cl.
*B08B 3/00* (2006.01)

(52) U.S. Cl.
USPC ..... 134/95.3; 134/56 D; 134/57 D; 134/58 D; 134/95.2; 134/102.3

(58) Field of Classification Search
USPC ..... 134/95.2
See application file for complete search history.

(56) References Cited

U.S. PATENT DOCUMENTS 3,026,628 A * 3/1962 Berger et al. ..... 34/231
3,068,877 A * 12/1962 Jacobs ..... 134/99.1

(Continued)

FOREIGN PATENT DOCUMENTS

DE 3418304 A1 * 11/1985
DE 3626887 A1 1/1988

(Continued)

OTHER PUBLICATIONS

Google machine English-language translation of DE 3418304 A1, Sep. 27, 2012.*

(Continued)

*Primary Examiner* — Michael Barr
*Assistant Examiner* — Levon J Shahinian
(74) *Attorney, Agent, or Firm* — Pearne & Gordon LLP

(57) ABSTRACT

The present invention describes a drying system for a dishwasher having a washing tub (2). The drying system comprises: a first fan (3) for propelling a first air stream through the washing tub (2) to an air transporting space (9) situated in the dishwasher outside the washing tub (2), wherein the first air stream is propelled in such a way that humidity in the washing tub (2) is absorbed by the first air stream and propelled to the air transporting space (9); and a second fan (4) for propelling a second air stream received from an area outside the dishwasher to the air transporting space (9). The drying system is further arranged such that the first and the second air streams are mixed in the air transporting space (9), and in that the mixed air stream is propelled to an exhaust opening (10) leading out from the dishwasher. Thereby, an efficient drying process can be achieved wherein air leaving the dishwasher has an appropriate temperature and humidity.

13 Claims, 2 Drawing Sheets

U.S. PATENT DOCUMENTS 4,657,036 A * 4/1987 Yake ..... 134/95.2
5,029,458 A * 7/1991 Obata et al. ..... 68/19.2

FOREIGN PATENT DOCUMENTS

DE 4029958 A1 11/1991
DE 102005023428 A1 * 11/2006

OTHER PUBLICATIONS

Google machine English-language translation of DE 102005023428 A1, Sep. 27, 2012.*
International Search Report for PCT/EP2008/01295, dated Apr. 22, 2008, 2 pages.

* cited by examiner

DRYING SYSTEM FOR A DISHWASHER

TECHNICAL FIELD

The present invention relates to a drying system for a dishwasher. The drying system can with advantage be used in a drawer dishwasher.

BACKGROUND

After items have been washed in a washing process of a dishwasher, the items are dried in a drying process. For performing such a drying process, the dishwasher is equipped with a drying system.

A closed drying system is shown in GB 2263969, in which a first fan circulates air in a closed system to and from a wash chamber through a circulation duct. Also, a second fan propels air received from outside the dishwasher via another duct in the dishwasher and further to an exhaust opening back to the outside of the dishwasher. A heat exchanger is located between the two ducts. Thereby, the hot, humid, air from the wash chamber is cooled by the cool air received from the outside, and water is condensed from the humidity of the circulated air and air with less humidity is led back into the wash chamber. Such a closed system has the drawback of having a rather low drying efficiency, resulting in a slow drying process.

In an open system, the drying process is performed by the humid air exiting to the surroundings outside the dishwasher. When humid air, comprising a high degree of water vapour, cools down at objects outside the dishwasher, there may be problems due to condensation at the objects, which may result in damp stains on floors or furniture, and other problems related to moist or damp. Also, if the temperature of the exiting humid air is high, it may be dangerous for a user of the dishwasher, or at least the exiting air may be uncomfortable for the user.

EP 1447042 shows a drying system for dishwashers, which is a mix of an open system and a closed system. The drying system has a fan comprising two stages, a first stage for drawing out humid air from the wash chamber and for returning the humid air to the wash chamber, and a second stage for drawing fresh air and using it for cooling the humid air drawn out from the wash chamber. The humid air of the first stage is circulated in the wash chamber via a channel that passes through a condenser. The condenser is cooled by the fresh air of the second stage. Also, a predetermined amount of humid air can be mixed with the fresh air. Thereby, the system described is a closed system with an exhaust air fraction. The possibility to mix an amount of the humid air with fresh air is used for achieving a more efficient drying process. The exhaust air fraction can be adjusted at design level or by installation to offer flexibility for different installations of the dishwasher. Such a solution has a higher efficiency than a totally closed system, and the exhaust air has a rather low temperature, although, the efficiency will not be as high as in an open system. Another drawback of this solution is that after the dishwasher has been installed the exhaust air fraction will be the same irrespective of whether a drying process has just started or it at its end, and irrespective of possible different selectable drying programs of the dishwasher, which would result in an exhaust air with varying exhaust air temperature and humidity. Therefore, there is still a need to achieve an efficient drying process, without risking that air leaving the dishwasher will give rise to moisture problems in the surroundings of the dishwasher.

SUMMARY

An object of the invention is to achieve an efficient drying process for dishes in a dishwasher, wherein air leaving the dishwasher has an appropriate temperature and humidity.

This is achieved by a drying system of a dishwasher according to claim 1, which has a first fan arranged for propelling a first air stream through the washing tub for absorbing humidity in the washing tub and propelling the humidified air stream out of the washing tub, and a second fan arranged for propelling a second air stream received from an area outside the dishwasher, and wherein the first and the second air streams are mixed before the mixed air stream is propelled to an exhaust opening leading out from the dishwasher.

Thereby, warm and humid air originating from the washing tub will be mixed with cool, dry air originating from the surroundings of the dishwasher, which will result in a mixed exhaust air having a lower concentration of humidity and a lower temperature, compared to the air exiting the washing tub. Since a second fan is used for achieving a forced air stream to be mixed with the humid air from the washing tub, it can be achieved that exhaust air from the dishwasher has a convenient temperature and a rather low concentration of humidity, even when the air received from the washing tub contains a high amount of humidity. Thereby, an efficient drying process can be used and still avoiding damages on kitchen furniture at the area close to the exhaust opening.

According to claim 2, the first fan and the second fan are controllable and operated independently of each other. By making the fans operating independently of each other, it is possible, if for example an increased humidity and/or temperature is expected in the washing tub, that for example the second fan may be operated harder than the first fan to achieve a lower concentration in the mixed air stream of air from the washing tub. This may be achieved by for example switching off the first fan at intervals while still operating the second fan. Thereby, humidity and/or temperature in the exhaust air can be kept on a level that will result in low amount of condensed water on the area close to the exhaust opening during the whole drying phase even when the amount of humidity and the temperature in the washing tub varies. This is much more difficult to achieve if the fans are operated depending of each other, e.g. by the same motor.

By arranging the drying system such that at least one of the first fan and the second fan are controllable such that the power of at least one of the fans is variable, according to claim 3, the speed and amount of air of the first air stream and the second air stream, respectively, can be controlled. Thereby, the fans can be better operated to achieve an appropriate temperature and humidity of the exhaust air depending on e.g. time of a drying process and different kinds of drying processes. In this way, the first and the second fan can complement each other such that for example the power of the second fan can increase and the power of the first fan can decrease or even stop if there are very much humidity in the washing tub, and consequently, very much humidity in the first air stream. Similarly, if there are not so much humidity or not so hot in the washing tub, the power of the first fan can increase at the same time as the power of the second fan can be kept constant, decrease, or even stop, to lower the drying time and keep the temperature and humidity in the exhaust flow rather constant.

In claim 4, the first fan and/or the second fan are controlled by a pre-programmed electronic program controller of the dishwasher. Thereby, different use cases can be tested before the dishwasher is on the market, and for each use case or drying cycle, an operation of the first and the second fan can be selected that gives an optimal drying process, and at the same time results in exhaust air that has a suitable temperature and humidity.

According to another embodiment, the drying system comprises at least one sensor arranged to sense temperature and/or humidity of at least one of the air streams. The values of temperature and/or humidity can then be used by the drying system to control the first and the second fan. Thereby, the operation of the first fan and the second fan can be controlled in dependence of current temperature and/or humidity of the air streams, and a suitable humidity and/or temperature can be achieved and maintained for the exhaust air. In one alternative of this embodiment a sensor is placed in the air transporting space to sense the humidity of the mixed air stream. Thereby, a direct feedback of the humidity in the exhaust air can be received at the drying system and can be used for controlling the first and/or the second fan.

According to another embodiment, the first fan is arranged to operate in a pulsed form and the second fan is arranged to operate continuously. The pulsing of the first fan has the advantage that the temperature on the dish load in the washing tub is reduced slower than if the first fan would be run continuously, with better evaporation as a result. Also, during the periods when the fan is stopped, dry air and humid air will be better mixed in the tub, such that humid air will be better transported out of the tub by the first air stream.

According to yet another embodiment, the drying system is arranged to control the first fan and the second fan such that the second fan starts to propel air before the first fan starts to propel air. The air in the second air stream, which passes just outside the washing tub, will be warmed up from the foregoing wash cycle, i.e. due to the washing tub being warm. This rather dry and warm air (e.g. with a temperature of 35 degrees Celsius) of the second air stream will then warm up the area outside the dishwasher close to the exhaust opening before air of the second air stream is mixed with humid air from the first air stream, thereby decreasing the risk of condensation in the area close to the exhaust opening.

According to still another embodiment of the invention, the first fan is placed above a motor of a washing pump of the dishwasher. The motor will become warm when it is operated and, therefore, the air around the motor will be warmed up. By placing the first fan above the motor, this warmed up air will be used as intake air for the first air stream. It is more advantageous to use warm air than cold air for the first air stream since warm air can absorb and carry more humidity than cold air. Therefore, such an embodiment would result in a more efficient drying process.

By arranging the drying system of the dishwasher such that air of the first air stream will flow diagonally through the washing tub, a maximally long distance will be covered by the first air stream through the washing tub. Thereby, absorption of humidity of the washing tub will be efficient.

According to another embodiment, the outlet channel is arranged as a condenser, and the outlet channel further has a third opening arranged in the bottom of the outlet channel, the third opening leading into the washing tub. Thereby, some of the humid air in the first air stream will be condensed in the outlet channel, and the condensed water will be lead back to the washing tub via the third opening. Since some of the air in the first air stream will be condensed in the outlet channel, the exhaust air will have a lower humidity with this embodiment of the invention.

The drying system can be used for any kind of dishwasher, but it is especially advantageous for a drawer dishwasher comprising one or more drawers arranged on top of each other, each drawer having an exhaust opening, which may be arranged at the door of the drawer.

According to another aspect of the invention, a dishwasher is described, comprising a drying system according to the invention.

BRIEF DESCRIPTION OF THE DRAWINGS

The invention will in the following be described in more detail with reference to the enclosed drawings, wherein.

DESCRIPTION OF EMBODIMENTS

Figure 1:
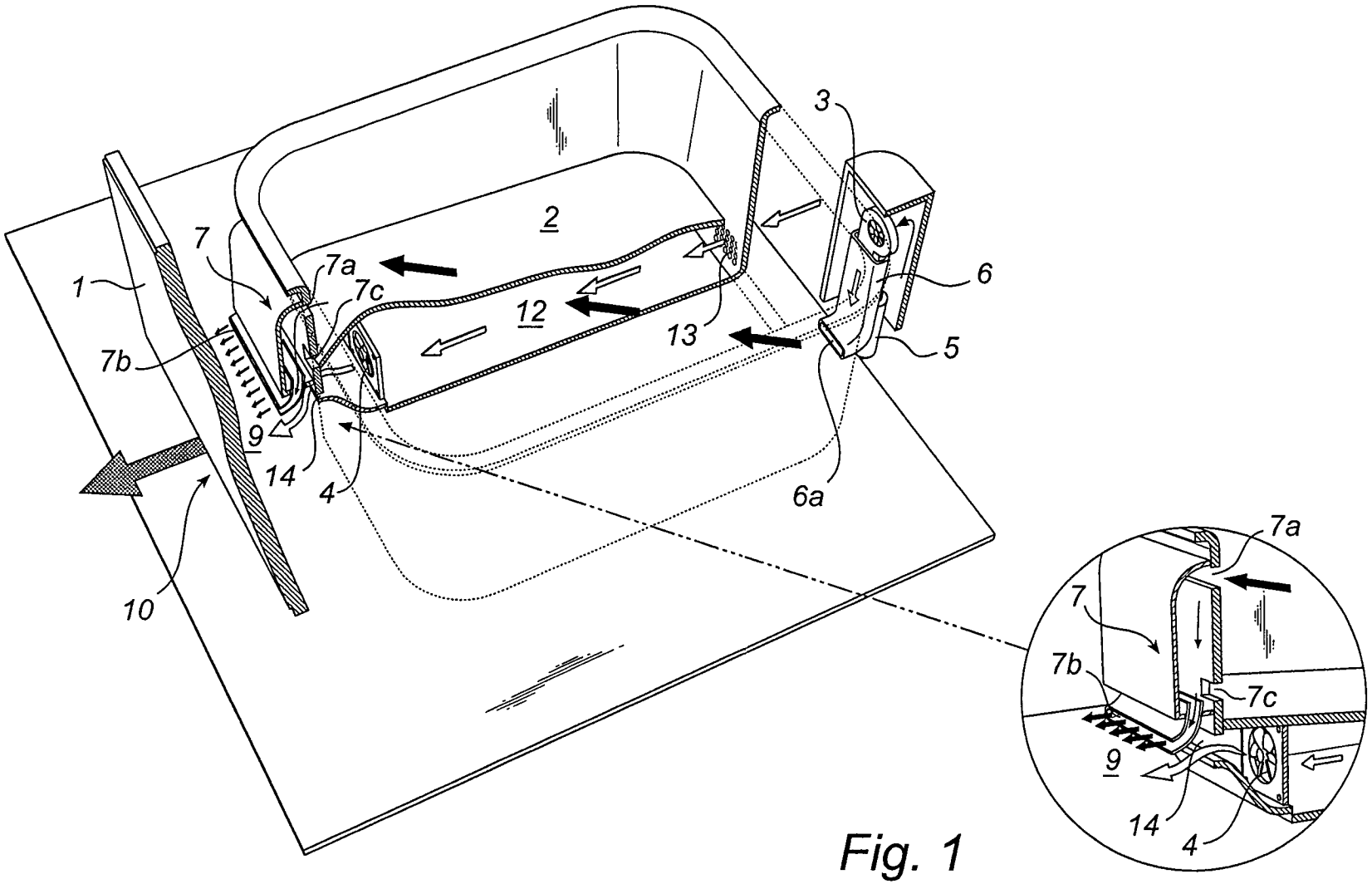
FIG. 1 schematically illustrates a perspective view from above of a dishwasher including a drying system according to the present invention.

The present invention will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. In the drawings, like numbers refer to like elements.

Figure 2:
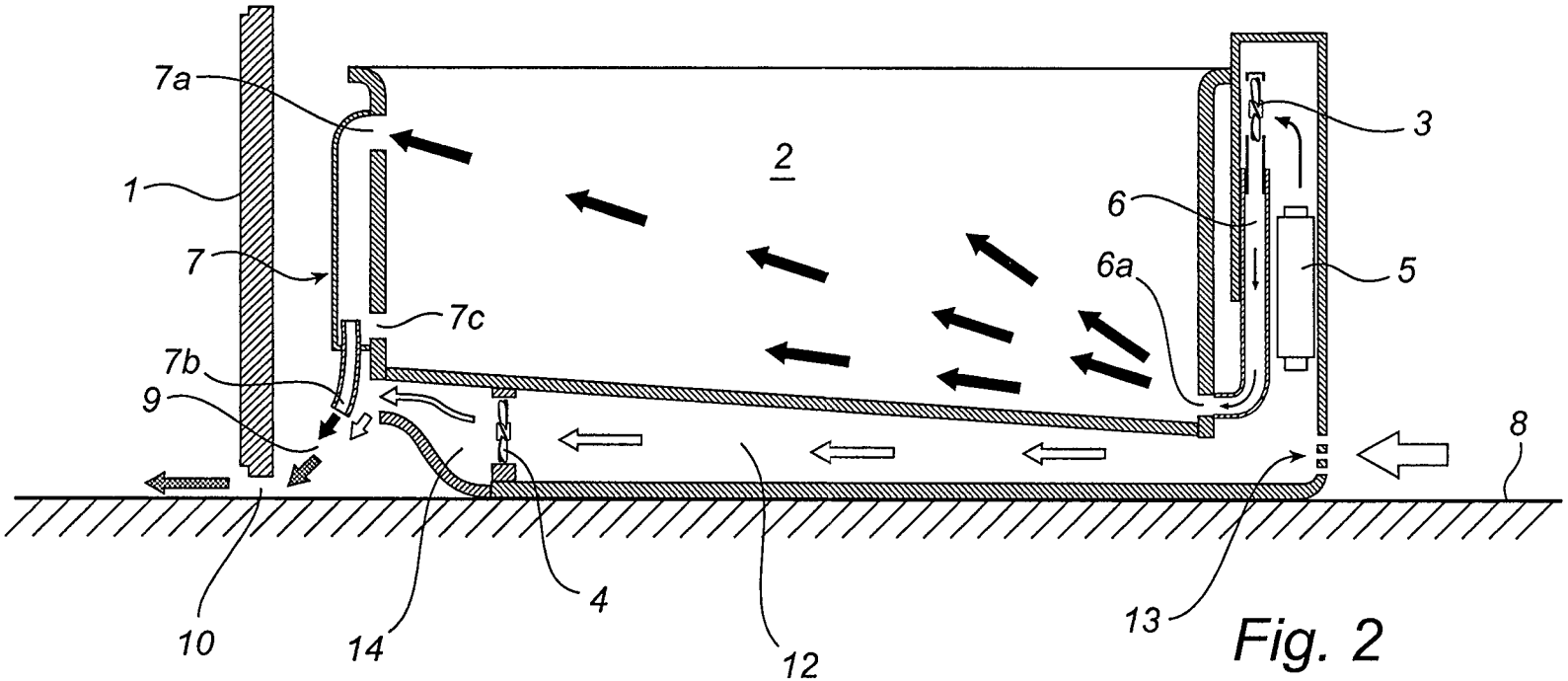
FIG. 2 schematically illustrates a side view of a dishwasher having a drying system according to the invention.

FIGS. 1 and 2 show a drawer dishwasher comprising a washing tub 2 for receiving items to be washed. The drawer dishwasher is intended to be arranged on a floor 8 of e.g. a kitchen with its backside facing a wall of the kitchen. The drawer dishwasher further has a cabinet (not shown) in which the washing tub 2 is arranged. On a front side of the dishwasher is a door 1 arranged. A user opens the drawer dishwasher by pulling the door in a direction out from the wall, whereby the washing tub also moves out from the wall. The dishwasher also has a water propelling system for circulating water into and out from the washing tub when the dishwasher is in a washing phase. Water in the water propelling system is propelled by a washing pump 5, which receives water from a pipe system (not shown) connected to a filter receptacle (not shown) in the bottom of the washing tub 2. The washing pump comprises a motor and an impeller driven by the motor. The washing pump propels water back into the washing tub via a second pipe system (not shown).

The dishwasher further comprises a drying system for drying items placed in the washing tub. The drying system is arranged to perform a drying process for drying the items placed in the washing tub. The drying process is preferably performed after the items have been washed clean in a washing process performed by the dishwasher.

The drying system comprises a drying fan 3 situated outside the washing tub 2, and arranged for propelling air into the washing tub via an inlet channel 6, which has an opening **6*a* leading into the washing tub. The opening 6*a* has a water lock for preventing water in the washing tub to flow into the inlet channel. The drying system further comprises an outflow channel 7. The outflow channel 7 has a first opening 7*a* leading into the washing tub 2 and a second opening 7*b* leading to an air transporting space 9, which is a space situated outside the washing tub but inside the dishwasher. The first opening 7*a* has a water lock for preventing water in the washing tub to flow into the outlet channel 7. The air transporting space 9 is situated such that it has direct access to an exhaust opening 10** leading out from the washing tub.

The drying fan 3 is arranged to propel an air stream (illustrated by black arrows in the figures) from an area close to the drying fan, via the inlet channel 6, through the washing tub 2, to the first opening 7*a* of the outlet channel 7, via the outlet channel 7 and further to the air transporting space 9. Such an air stream propelled by the drying fan will absorb humidity in the washing tub 2 which humidity will be propelled together with the first air stream out from the washing tub to the air transporting space 9 and further out from the dishwasher via the exhaust opening 10. Thereby, the air inside the washing tub, and, consequently, the items in the washing tub will be dried.

Although, there is a problem with such a drying system in that the air leaving the dishwasher may be very humid and hot. This may cause damages to areas close to the exhaust opening, due to condensation at these area, which may result in damp stains on floors or furniture, and other problems related to moist or damp. Also, if hot air exits through the exhaust opening it may be dangerous to a person standing close to the exhaust opening. Therefore, the drying system according to the invention further has a mixer fan 4 arranged in the dishwasher outside the washing tub 2. The mixer fan 4 may be arranged in an enclosure 12 situated below the washing tub 2. The drying system further has an inlet 13 leading from an area outside the dishwasher to the enclosure 12 below the washing tub where the mixer fan 4 is situated, and a duct 14 leading from the mixer fan 4 to the air transporting space 9. The mixer fan 4 is arranged to propel an air stream of air drawn in from outside the dishwasher via the inlet 13 and the enclosure 12 to the mixer fan and further via the duct 14 to the air transporting space 9. This air stream is illustrated with white arrows in the figures. In the air transporting space 9, humid, hot air received from the washing tub, propelled by the drying fan 3 is mixed with less hot, dry air received from the mixer fan 4, before the mixed air is propelled further as a mixed air stream (illustrated in the figures as arrows illustrated with black dots on a white background) by the two fans and exhausted in the open air via the exhaust opening 10.

Thereby, a forced air stream of dry air of a sufficient amount can be established, which when mixed with the humid air will result in a mixed air with a low enough humidity for achieving an exhaust air that will not cause damp damages on the environment around the dishwasher. At the same time, such a drying system can achieve a fast drying process.

According to an embodiment of the invention, the mixer fan 4 and the drying fan 3 are controllable and operated independently from each other, e.g. the fans may be operated by different motors. If the fans are operated independently of each other, it is possible, if e.g. a higher humidity of the air propelled by the drying fan is expected, that the mixer fan can be propelled harder and that the drying fan can be propelled less hard or even be stopped for a while, such that a convenient humidity of the exhaust air can be achieved even if the humidity is varied. If the fans are operated depending on each other it is not possible to vary the air streams to the same extent to be able to achieve an exhaust air with convenient humidity as if they are operated independently of each other.

Also, the power of the mixer fan 4 and/or the drying fan 3 can be varied such that the amount and speed of the air propelled by each of the fans can be varied. In addition, the drying system may be equipped with sensors for measuring the humidity and/or the temperature of air in the different air streams. Advantageously, a sensor is placed in the air-mixing zone 9 to measure the humidity of the mixed air stream. The drying fan 3 and the mixer fan 4 are then controlled according to the measured value of the sensor to achieve a mixed air stream with a suitable humidity and temperature.

According to another embodiment, the drying fan 3 may be placed above the washing pump 5, in an upper part of a washing pump chamber, which washing pump chamber comprises the washing pump and its a motor, and perhaps also a heater for heating the water used in the washing pump. The air propelled by the drying fan is then automatically preheated by heat generated from the details in the washing pump chamber. Since warm air can carry more humidity than cool air it may be advantageous to have the air preheated to achieve a more efficient drying process.

During a drying cycle, the mixer fan 4 can be arranged to be driven continuously and the drying fan 3 can be arranged to be driven in a pulsed mode, i.e. the drying fan is then switched on and off with regular intervals. Thereby, the exhaust air can be controlled both in terms of temperature and humidity. The pulsing of the drying fan will also have the advantage that the temperature in the washing tub 2 is reduced slower with better evaporation as a result. Also, when the drying fan is stopped there will be better equalization of dry air and humid air in the tub, such that more humidity is lead out of the washing tub when the drying fan is switched on after a stop than before the stop. The pulsation can be varied to increase or decrease the periods when the fan is switched off and/or to increase or decrease the periods when the fan is switched on.

The drying system may also be arranged to control the drying fan 3 and the mixer fan 4 such that the mixer fan 4 starts to propel air before the drying fan 3 starts to propel air. This is especially advantageous if the air propelled by the mixer fan is lead immediately at the outside of the washing tub, because after a washing phase the washing tub will be warmed up, and the air transported at the outside of the washing tub will then be warmed up by the warm washing tub. The warm air propelled by the mixer fan is then propelled out to the exhaust opening 10 and can be used to warm up the area around the exhaust opening. Thereby, there will be a lower possibility of condensation at these areas when the drying fan 3 starts and the humid air from the washing tub is mixed in the exhaust air.

According to another embodiment, the opening 6*a* of the inlet channel 6, leading the air stream propelled by the drying fan into the washing tub, is placed in the lower part of one wall of the washing tub, and the opening 7*a* of the outlet channel 7 leading this air stream out of the washing tub is placed in the higher part of another wall of the washing tub. The openings are preferably placed such that the longest possible way through the washing tub is achieved for the air propelled by the drying fan through the washing tub. Thereby, the highest amount of humidity can be absorbed in the washing tub. Preferably, the openings 6*a*, 7*a* are placed diagonally at opposite walls of the washing tub.

The outlet channel 7 is arranged as a condenser, such that some of the humidity absorbed in the washing tub is condensed into water in the outlet channel. Since some of the steam will condense, the degree of humidity in the air propelled from the washing tub 2 to the air transporting space 9 will be lower than if no condenser will be at hand. For receiving the condensed water, the outlet channel 7 further has a third opening 7*c* arranged in the bottom of the outlet channel and leading into the washing tub 2. The third opening 7*c* has a water lock for preventing water to flow into the third opening from the washing tub. Further, the second opening 7*b* may be formed as a duct having an entrance for air inside the outlet channel 7, and an exit leading to the air transporting space 9. The entrance is arranged spaced from inner walls of the outlet channel 7 and above the third opening 7*c*. Thanks to this arrangement, the condensed water will flow back into the washing tub 2 via the third opening 7*c* and it is avoided that condensed water may flow into the air transporting space 9.

In another embodiment, the inlet 13 leading from the area surrounding the dishwasher to the enclosure 12 where the mixer fan 4 is situated, is preferably situated in the backside of the dishwasher, and the exhaust opening 10 is preferably situated in the front side of the dishwasher. Although other embodiments may be construed, as long as the air for the mixer fan is taken from outside the dishwasher.

In the embodiment shown in the figure, the exhaust opening 10 is situated below the door 1 of the dishwasher adjacent to the floor on which the dishwasher is arranged to be placed, e.g. in a plinth arranged between the door and the floor. The exhaust opening 10 might as well be positioned at other places of the dishwasher, although it is preferable that the exhaust opening is positioned such that it has direct access to free air outside the dishwasher, for example by placing the exhaust opening on the front side of the dishwasher.

Any kind of fans can be used for the drying fan and the mixer fan. Although, it has been experienced that low-Volt DC-driven fans are most appropriate since they are more space saving and have less weight compared to AC-driven fans.

In the embodiment described in the figures, the mixer fan is placed in an enclosure below the washing tub. Although, in alternative embodiments there might not be an enclosure below the washing tub. In that case, the mixer fan may be arranged immediately under the bottom of the washing tub, such that it is placed between the bottom of the washing tub and the floor, and the inlet 13 is arranged such that it can lead air from outside the dishwasher towards the mixer fan 4. In yet other embodiments, the mixer fan may be placed at any of the vertical walls of the washing tub, outside the washing tub.

In the figures, a drawer dishwasher comprising one drawer is shown. Although, the invention might as well be used for a drawer dishwasher comprising more than one drawer arranged on top of each other. In that case, each drawer comprises a washing tub. Also, each drawer preferably has its own drying system, such that the drying systems can be driven independently of each other.

Although the embodiment described above describes a drawer dishwasher, the drying system according to the invention might as well be used for a conventional dishwasher.

In the drawings and specification, there have been disclosed preferred embodiments and examples of the invention and, although specific terms are employed, they are used in a generic and descriptive sense only and not for the purpose of limitation, the scope of the invention being set forth in the following claims.

The invention claimed is:

1. A drying system for a dishwasher comprising a washing tub (2) and a pre-programmed electronic program controller, the drying system comprising:

a first fan (3) configured to propel a first air stream through the washing tub (2) to an air transporting space (9) situated in the dishwasher outside the washing tub (2) such that the first air stream absorbs humidity in the washing tub (2);

a second fan (4) configured to propel a second air stream received from an area outside the dishwasher to the air transporting space (9); and an exhaust opening (10) leading out from the dishwasher, the exhaust opening (10) being configured to convey a mixed air stream from the air transporting space (9), wherein the first (3) and second (4) fans are configured to cause the first and second air streams to mix in the air transporting space (9) to form the mixed air stream, and wherein the pre-programmed electronic program controller is configured to control the first fan (3) and the second fan (4) to cause, at a beginning of drying cycle, the second fan (4) to propel the second air stream before the first fan (3) propels the first air stream.

2. A drying system according to claim 1, wherein the first fan (3) and the second fan (4) are controllable, and wherein the first fan (3) and the second fan (4) are operated independently of each other.

3. A drying system according to claim 2, wherein the first fan (3) and/or the second fan (4) are controllable such that power of the first fan (3) and/or the second fan (4) is variable.

4. A drying system according to claim 2, further comprising:

one or more sensors arranged to sense temperature and/or humidity of the first air stream, the second air stream, the mixed air stream, or any combination thereof, wherein the pre-programmed electronic program controller is configured to use values of the temperature and/or the humidity sensed by the one or more sensors to control the first fan (3) and the second fan (4).

5. A drying system according to claim 4, wherein at least one of the sensors is arranged in the air transporting space (9) to sense the humidity of the mixed air stream.

6. A drying system according to claim 2, wherein the first fan (3) is arranged to be operated in a pulsed form during a drying cycle of the dishwasher and the second fan (4) is arranged to be operated continuously during the drying cycle of the dishwasher.

7. A drying system according to claim 1, wherein the first fan (3) is situated outside the washing tub (2), the drying system further comprising:

an inlet channel (6) having an opening (6*a*) leading into the washing tub (2), the inlet channel being arranged to guide air propelled from the first fan (3) to the washing tub via its opening (6*a*);

an outlet channel (7) having a first opening (7*a*) leading into the washing tub (2) and a second opening (7*b*) leading into the air transporting space (9), and wherein the first fan (3) is arranged to propel the air from an area close to the first fan, via the inlet channel (6), through the washing tub (2) where the humidity in the washing tub is absorbed, to the outlet channel (7) and further to the air transporting space (9).

8. A drying system according to claim 7, wherein the opening (6*a*) of the inlet channel (6) is situated in a lower section of a wall of the washing tub (2) and the first opening (7*a*) of the outlet channel (7) is situated in an upper section of another wall of the washing tub, and in that the inlet channel opening (6*a*) and the first opening (7*a*) of the outlet channel (7) are arranged on the respective walls of the washing tub (2) such that air of the first air stream will flow diagonally through the washing tub.

9. A drying system according to claim 1, wherein the second fan (4) is arranged in an enclosure (12) situated below the washing tub (2), the drying system further comprising:

an inlet (13) leading from the area surrounding the dishwasher to the enclosure (12) below the washing tub;

a duct (14) leading from the second fan (4) to the air transporting space (9);

wherein the second fan (4) is arranged to propel air from the inlet (13) via the duct (14) to the air transporting space (9).

10. A drying system according to claim 9, wherein the inlet (13) is situated in a backside of the dishwasher, and wherein the exhaust opening (10) is situated in a front side of the dishwasher.

11. A drying system according to claim 7, wherein the outlet channel (7) is arranged as a condenser, the outlet channel further having a third opening (7*c*) arranged in a bottom of the outlet channel, the third opening (7*c*) leading into the washing tub (2).

12. A dishwasher comprising a drying system according to claim 1.

13. The drying system according to claim 1, wherein the washing tub (2) is configured to heat the second air stream propelled by the second fan (4) at the beginning of the drying cycle.

* * * * *

UNITED STATES PATENT AND TRADEMARK OFFICE

CERTIFICATE OF CORRECTION

PATENT NO. : 8,469,043 B2
APPLICATION NO. : 12/527329
DATED : June 25, 2013
INVENTOR(S) : Anders Tolf It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 980 days.

Signed and Sealed this
Eighth Day of September, 2015

Michelle K. Lee

Michelle K. Lee
*Director of the United States Patent and Trademark Office*